US005504563A

United States Patent [19]

Hays

[11] Patent Number: 5,504,563

[45] Date of Patent: Apr. 2, 1996

[54] SCAVENGELESS DONOR ROLL DEVELOPMENT

[75] Inventor: Dan A. Hays, Fairport, N.Y.

[73] Assignee: Xerox Corporation, Stamford, Conn.

[21] Appl. No.: 417,713

[22] Filed: Apr. 6, 1995

Related U.S. Application Data

[63] Continuation of Ser. No. 724,242, Jul. 1, 1991, abandoned.

[51] Int. Cl.[6] ..... G03G 15/06

[52] U.S. Cl. ..... 355/261; 118/651

[58] Field of Search ..... 355/259, 261, 355/262, 265; 118/647, 648, 651, 661; 347/140–142, 158

[56] References Cited

U.S. PATENT DOCUMENTS

| | | | |
|---|---|---|---|
| 3,457,900 | 7/1969 | Drexler | 118/658 |
| 3,900,001 | 8/1975 | Fraser et al. | 118/658 |
| 3,996,892 | 12/1976 | Parker et al. | 118/658 |
| 4,078,929 | 3/1978 | Sundlach | 430/42 |
| 4,308,821 | 1/1982 | Matsumoto et al. | 118/645 |
| 4,478,505 | 10/1984 | Tashiro | 355/245 |
| 4,486,089 | 12/1984 | Itaya et al. | 355/251 |
| 4,491,855 | 1/1985 | Fujii et al. | 346/159 |
| 4,515,106 | 5/1985 | Kohyama | 118/651 |
| 4,527,884 | 7/1985 | Nusser | 118/647 X |
| 4,568,955 | 2/1986 | Hosoya et al. | 346/153.1 |
| 4,598,991 | 7/1986 | Hosoya et al. | 355/262 X |
| 4,647,179 | 3/1987 | Schmidlin | 355/262 |
| 4,656,427 | 4/1987 | Dauphinee | 324/444 |
| 4,743,926 | 5/1988 | Schmidlin et al. | 346/159 |
| 4,810,604 | 3/1989 | Schmidlin | 430/42 |
| 4,833,504 | 5/1989 | Parker et al. | 355/326 |
| 4,868,600 | 9/1989 | Hays et al. | 355/259 |

FOREIGN PATENT DOCUMENTS

| | | |
|---|---|---|
| 0181372 | 10/1984 | Japan . |
| 0273563 | 12/1986 | Japan . |

OTHER PUBLICATIONS

Couch II, Digital and Analog Communication Systems, 1987, p. 23.

*Primary Examiner*—Robert Beatty

[57] ABSTRACT

A scavengeless or non-interactive development system is described for use in image formation such as highlight color imaging. A toned donor roll structure having two sets of interdigitated electrodes physically supported by an insulative support structure is provided. An equal magnitude DC potential is applied to both sets of electrodes while an AC potential is applied to either one or both sets of electrodes. The AC and DC biases are such as to preclude background development without creating fringe DC fields between adjacent electrodes.

12 Claims, 2 Drawing Sheets

SCAVENGELESS DONOR ROLL DEVELOPMENT

This is a continuation, of application Ser. No. 07/724,242, filed Jul. 1, 1991, now abandoned.

BACKGROUND OF THE INVENTION

This invention relates generally to the rendering of latent electrostatic images visible using multiple colors or otherwise distinctive dry toner or developer and more particularly to a development system that does not scavenge or interact with a previously toned image.

The invention can be utilized in the art of xerographic copying or in the printing arts. In the practice of conventional xerography, it is the general procedure to form electrostatic latent images on a xerographic surface by first uniformly charging a photoreceptor. The photoreceptor comprises a charge retentive surface. The charge is selectively dissipated in accordance with a pattern of activating radiation corresponding to original images. The selective dissipation of the charge leaves bi-level latent charge patterns on the imaging surface corresponding to the areas exposed (i.e. background areas) and those areas (i.e. image areas) not exposed by radiation.

These charge pattern 5 are rendered visible by developing them with toner. The toner is generally a black powder which adheres to the charge pattern by electrostatic attraction.

The developed image is then fixed to the imaging surface or is transferred to a receiving substrate such as plain paper to which it is fixed by suitable fusing techniques.

The concept of tri-level, highlight color xerography is described in U.S. Pat. No. 4,078,929 issued in the name of Gundlach. The patent to Gundlach teaches the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

In highlight color xerography as taught by Gundlach, the xerographic contrast on the charge retentive surface or photoreceptor is divided into three levels, rather than two levels as is the case in conventional xerography. The photoreceptor is charged, typically to 900 volts. It is exposed imagewise, such that one image corresponding to charged image areas (which are subsequently developed by charged-area development, i.e. CAD) stays at the full photoreceptor potential ($V_{cad}$ or $V_{ddp}$). The other image is exposed to discharge the photoreceptor to its residual potential, i.e. $V_{dad}$ or $V_c$ (typically 100 volts) which corresponds to discharged area images that are subsequently developed by discharged-area development (DAD) and the background areas exposed such as to reduce the photoreceptor potential to halfway between the $V_{cad}$ and $V_{dad}$potentials, (typically 500 volts) and is referred to as $V_{white}$ or $V_w$. The CAD developer is typically biased about 100 volts closer to $V_{cad}$ than $V_{white}$ (about 600 volts), and the DAD developer system is biased about 100 volts closer to $V_{dad}$ than $V_{white}$ (about 400 volts).

The viability of printing system concepts such as tri-level, highlight color xerography requires development systems that do not scavenge or interact with a previously toned image. Since commercial development systems such as conventional magnetic brush development and jumping single component development interact with the image receiver, a previously toned image will be scavenged by subsequent development. Since the present commercial development systems are highly interactive with the image bearing member, there is a need for scavengeless or non-interactive development systems.

It is known in the art to alter the magnetic properties of the magnetic brush in the second housing in order to obviate developer material interactions. For example,there is disclosed in U.S. Pat. No. 4,308,821 granted on Jan. 5, 1982 to Matsumoto, et al, an electrophotographic development method and apparatus using two magnetic brushes for developing two-color images which allegedly do not disturb or destroy a first developed image during a second development process. This is because a second magnetic brush contacts the surface of a latent electrostatic image bearing member more lightly than a first magnetic brush and the toner scraping force of the second magnetic brush is reduced in comparison with that of the first magnetic brush by setting the magnetic flux density on a second non-magnetic sleeve with an internally disposed magnet smaller than the magnetic flux density on a first magnetic sleeve, or by adjusting the distance between the second non-magnetic sleeve and the surface of the latent electrostatic image bearing members. Further, by employing toners with different quantity of electric charge, high quality two-color images are obtained.

U.S. Pat. No. 3,457,900 discloses the use of a single magnetic brush for feeding developer into a cavity formed by the brush and an electrostatic image bearing surface faster than it is discharged thereby creating a roll-back of developer which is effective in toning an image. The magnetic brush is adapted to feed faster than it discharges by placement of strong magnets in a feed portion of the brush and weak magnets in a discharge portion of the brush.

U.S. Pat. No. 3,900,001 discloses an electrostatographic developing apparatus utilized in connection with the development of conventional xerographic images. Developer material is applied to a developer receiving surface in conformity with an electrostatic charge pattern wherein the developer is transported from the developer supply to a development zone while maintained in a magnetic brush configuration and thereafter, transported through the development zone magnetically unconstrained but in contact with the developer receiving surface.

As disclosed in U.S. Pat. No. 4,486,089 granted on Dec. 4, 1984 to Itaya, et al a magnetic brush developing apparatus for a xerographic copying machine or electrostatic recording machine has a sleeve in which a plurality of magnetic pieces are arranged in alternating polarity. Each piece has a shape which produces two or more magnetic peaks. The sleeve and the magnets are rotated in opposite directions. As a result of the above, it is alleged that a soft developer body is obtained, and density unevenness or stripping of the image is avoided.

U.S. Pat. No. 4,833,504 granted on May. 23, 1989 to Parker et al discloses a magnetic brush developer apparatus comprising a plurality of developer housings each including a plurality of magnetic rolls associated therewith. The magnetic rolls disposed in a second developer housing are constructed such that the radial component of the magnetic force field produces a magnetically free development zone intermediate to a charge retentive surface and the magnetic rolls. The developer is moved through the zone magnetically unconstrained and, therefore, subjects the image developed by the first developer housing to minimal disturbance. Also, the developer is transported from one magnetic roll to the next. This apparatus provides an efficient means for developing the complimentary half of a tri-level latent image while at the same time allowing the already developed first half to pass through the second housing with minimum image disturbance.

U.S. Pat. No. 4,810,604 granted to Fred W. Schmidlin on Mar. 7, 1989 discloses a printing apparatus wherein highlight color images are formed without scavenging and re-development of a first developed image. A first image is formed in accordance with conventional (i.e. total voltage range available) electrostatic image forming techniques. A successive image is formed on the copy substrate containing the first image subsequent to first image transfer, either before or after fusing, by utilization of direct electrostatic printing. Thus,the '604 patent solves the problem of developer interaction with previously recorded images by forming a second image on the copy substrate instead of on the charge retentive surface on which the first image was formed.

U.S. Pat. No. 4,478,505 issued on Oct. 23, 1984 relates to developing apparatus for improved charging of flying toner. The apparatus disclosed therein comprises a conveyor for conveying developer particles from developer supplying means to a photoconductive body positioned to define a gap therebetween. A developer supplying passage for conveying developer particles is provided between the developer supplying means and the gap. The developer supplying passage is defined by the conveyor and an electrode plate provided with a predetermined interval with the conveyor. An alternating electric field is applied to the developer supplying passage by an AC power source to reciprocate the developer particles between the conveyor and the electrode plate thereby sufficiently and uniformly charging the developer particles by friction. In the embodiment disclosed in FIG. 6 of the '505 patent, a grid is disposed in a space between the photosensitive layer and a donor member.

U.S. Pat. No. 4,568,955 issued on Feb. 4, 1986 to Hosoya et al discloses a recording apparatus wherein a visible image based on image information is formed on an ordinary sheet by a developer. The recording apparatus comprises a developing roller spaced at a predetermined distance from and facing the ordinary sheet and carrying the developer thereon, a recording electrode and a signal source connected thereto, for propelling the developer on the developing roller to the ordinary sheet by generating an electric field between the ordinary sheet and the developing roller according to the image information, a plurality of mutually insulated electrodes provided on the developing roller and extending therefrom in one direction, an AC and a DC source are connected to the electrodes, for generating an alternating electric field between adjacent ones of the electrodes to cause oscillations of the developer found between the adjacent electrodes along electric lines of force therebetween to thereby liberate the developer from the developing roller.

U.S. Pat. No. 4,656,427 granted to Hosaka et al on Mar. 31, 1987 discloses a method and apparatus wherein a layer of developer which is a mixture of insulative, magnetic particles and insulative toner particles is carried on the surface of a developer sleeve forming part of a magnetic brush. A latent image bearing member carrying an image to be developed is moved relative to the magnetic brush . The brush is spaced from the image bearing member and an AC field is formed across the space to effect toner transfer to the image and non-image areas and to effect a back transfer of excessive toner.

Japanese publication 62-70881 discloses a toner separating means using a plurality of electrically biased grid wires disposed intermediate a magnetic brush developer roll and an imaging surface. The two-component developer is triboelectrified and magnetic carrier is removed from the outer periphery of a sleeve by the action of the north and south poles of the magnetic poles of the magnetic brush.

U.S. Pat. No. 4,868,600 granted to Hays et al on Sep. 19, 1989 and assigned to the same assignee as the instant application discloses a scavengeless development system in which toner detachment from a donor and the concomitant generation of a controlled powder cloud is obtained by AC electric fields supplied by self-spaced electrode structures positioned within the development nip. The electrode structure is placed in close proximity to the toned donor within the gap between the toned donor and image receiver, self-spacing being effected via the toner on the donor. Such spacing enables the creation of relatively large electrostatic fields without risk of air breakdown.

U.S. patent application Ser. No. 424,482, now U.S. Pat. No. 5,031,572 filed on Oct. 20, 1989 and assigned to the same assignee as the instant application discloses a scavengeless development system for use in highlight color imaging. AC biased electrodes positioned in close proximity to a magnetic brush structure carrying a two-component developer cause a controlled cloud of toner to be generated which non-interactively develops an electrostatic image. The two-component developer includes mixture of carrier beads and toner particles. By making the two-component developer magnetically tractable, the developer is transported to the development zone as in conventional magnetic brush development where the development roll or shell of the magnetic brush structure rotates about stationary magnets positioned inside the shell.

Some highlight and process color electronic printing concepts are based on multiple xerographic development of an electrostatic latent image on either a photoreceptor or electroreceptor. These printing system concepts can be enabled by development system designs that do not scavenge/interact with a previously toned image or cause cross contamination of the development systems. Since the present commercial two component development systems such as magnetic brush development and single component systems such as AC jumping interact with the image bearing member, there is a need to identify scavengeless or non-interactive development systems. Recent developments which address this need include powder cloud development systems based on AC fringe electric field toner detachment from a toned donor roll. The AC fringe electric field is provided by self-spaced AC biased electrode structures such as wires positioned within the development nip. This configuration is incorporated in a single component development system ('600 patent mentioned above) and a scavengeless hybrid system discussed with reference to the '482 application noted above in which the toned donor is supplied by two component magnetic brush development.

For some toner materials, the tensioned AC biased wires in self-spaced contact ('600 patent discussed above) with the toned roll tend to vibrate which can cause nonuniform solid area development. Some toner materials cause increased toner removal at the ends of the donor roll through a snowplowing action. Furthermore, there is the possibility that debris can momentarily lodge on a wire to cause streaking. In view of these possible problems for some toner materials, it is preferred to provide the AC fringe electric field by an electrode structure incorporated in the donor roll to circumvent problems associated with relative motion between the electrode structure and toned roll. Furthermore, elimination of the electrode structure in the development nip would obviate the need for a structure to tension and position the wire electrodes within the development nip.

Electrode structures incorporated within a development roll have been described by Parker and Scaletta (U.S. Pat. No. 3,996,892) for shaping the DC electric field profile across the development zone of a magnetic brush development system.

The Hosoya patent (U.S. Pat. No. 4,568,955) also discloses a development or donor roll having electrode structures incorporated therein. Copper electrode structures are deposited on the insulated surface of a donor roll. In one rotational position of the Hosoya et al donor roll, a DC voltage is supplied to alternate ones of the copper electrodes while an AC voltage is supplied to the electrodes intermediate the electrodes having the DC voltage applied thereto. In another rotational position of this donor roll the AC and DC voltages are applied to the opposite electrodes. In other words, each electrode when positioned in the development nip first has one kind of voltage applied and then the other. The AC voltage establishes an alternating electric field for liberating toner particles on the surface of the donor roll. According to the Hosoya et al description, when the AC voltage is greater than the DC voltage the toner particles move from one electrode to an adjacent electrode and when the AC voltage is less than the DC voltage the toner particles move in the opposite direction between two adjacent electrodes.

BRIEF SUMMARY OF THE INVENTION

In accordance with the present invention, an aerosol layer of toner is formed using an interdigitated donor electrode structure including at least two sets of electrodes supported in close proximity to a toner layer on the surface of donor structure. A DC potential is applied to both sets of electrodes while an AC potential is applied to either one or both sets of electrodes.

The AC applied potential serves to establish alternating electrostatic fields between adjacent electrodes for liberating toner particles from the surface of the donor structure.

The DC potential applied to both sets of electrodes provides a DC electrostatic field between the donor structure and a photoconductive imaging surface for effecting movement of toner from the former to the latter. By applying a predetermined DC bias other than zero to the electrodes, development of the background areas of the photoconductive surface is precluded.

Referencing the AC bias to the DC bias results in the time average of the AC being equal to the DC biases. Thus, the equal DC on adjacent electrodes precludes the creation of DC electrostatic fields between adjacent electrodes which would impede toner liberation by the AC fields.

DETAILED DESCRIPTION OF THE PREFERRED EMBODIMENTS OF THE INVENTION

Figure 1:
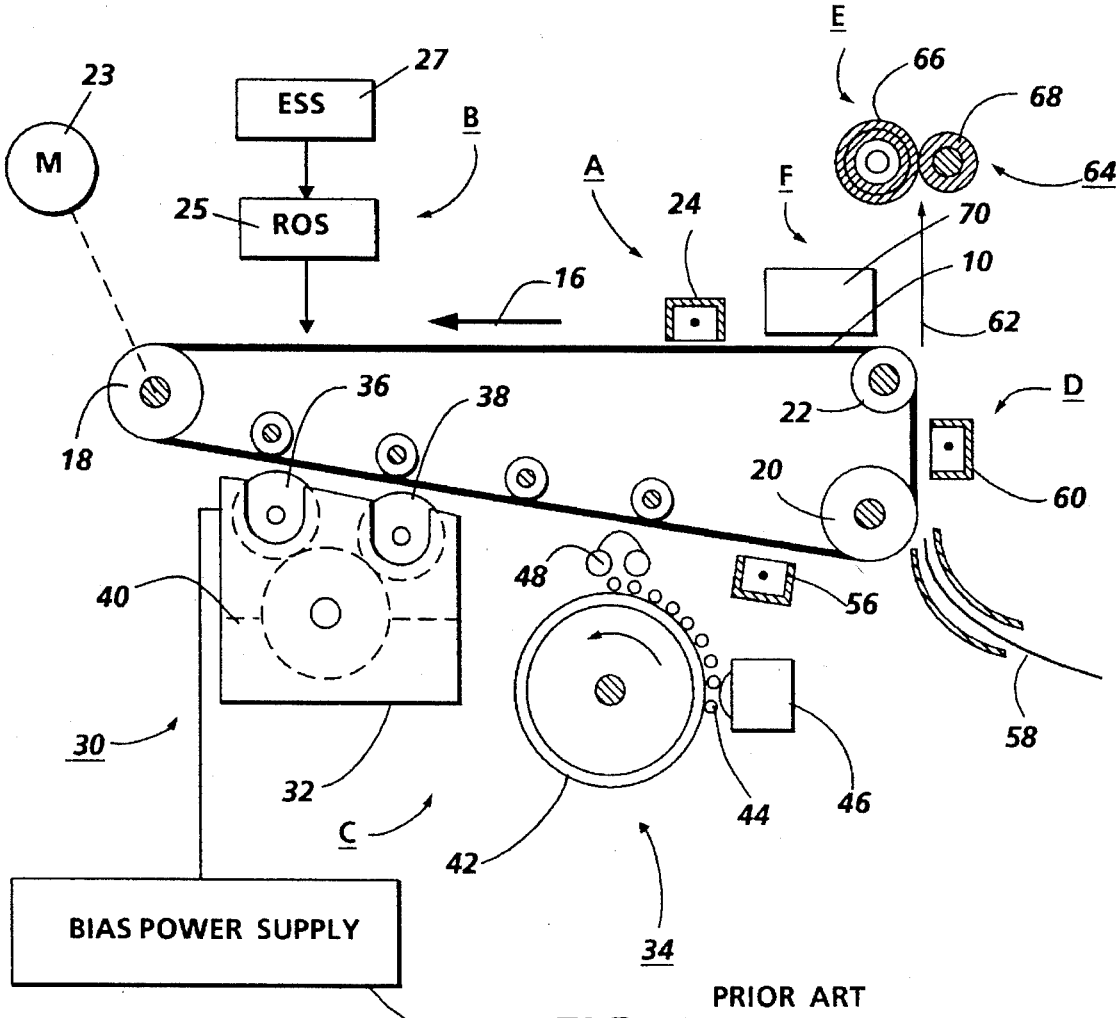
PRIOR ART FIG. 1
FIG. 1 is schematic illustration of a printing apparatus incorporating the inventive features of the invention.

As shown in FIG. 1, a highlight color printing machine of the prior art in which the invention may be utilized comprises a charge retentive member in the form of a photoconductive belt 10 consisting of a photoconductive surface and an electrically conductive substrate and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 1, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, $V_0$. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device. Preferably the scanning device is a three level laser Raster Output Scanner (ROS). Alternatively, the ROS could be replaced by a conventional xerographic exposure device. An electronic subsystem (ESS) 27 provides for control of the ROS as well as other subassemblies of the machine.

The photoreceptor, which is initially charged to a voltage $V_0$, undergoes dark decay to a level $V_{ddp}$ equal to about −900 volts. When exposed at the exposure station B it is discharged to $V_c$ equal to about −100 volts which is near zero or ground potential in the highlight (i.e. color other than black) color parts of the image. The photoreceptor is also discharged to $V_w$ equal to approximately −500 volts imagewise in the background (white) image areas.

At development station C, a development system, indicated generally by the reference numeral 30 advances developer materials into contact with the electrostatic latent images. The development system 30 comprises first and second developer apparatuses 32 and 34. The developer apparatus 32 comprises a housing containing a pair of magnetic brush rollers 36 and 38. The rollers advance developer material 40 into contact with the latent images on the charge retentive surface which are at the voltage level $V_c$. The developer material 40 by way of example contains color toner and magnetic carrier beads. Appropriate electrical biasing of the developer housing is accomplished via power supply 41 electrically connected to developer apparatus 32. A DC, bias of approximately –400 volts is applied to the rollers 36 and 38 via the power supply 41. With the foregoing bias voltage applied and the color toner suitably charged, discharged area development (DAD) with colored toner is effected.

The second developer apparatus 34 comprises a donor structure in the form of a roller 42. The donor structure 42 conveys developer 44, which in this case is a single component developer comprising black toner deposited thereon via a combination metering and charging device 46, to an area adjacent an electrode structure. The toner metering and charging device can also be provided by a two component developer system such as a magnetic brush development structure. The donor structure can be rotated in either the 'with' or 'against' direction vis-a-vis the direction of motion of the charge retentive surface. The donor roller 42 is preferably coated with TEFLON-S (trademark of E. I. DuPont De Nemours) or anodized aluminum.

The developer apparatus 34 further comprises an electrode structure 48 which is disposed in the space between the charge retentive surface 10 and the donor structure 42. The electrode structure is comprised of one or more thin (i.e. 50 to 100 μm diameter) tungsten wires which are positioned closely adjacent the donor structure 42. The distance between the wires and the donor is approximately 25 μm or the thickness of the toner layer on the donor roll. Thus, the wires are self-spaced from the donor structure by the thickness of the toner on the donor structure. For a more detailed description of the foregoing, reference may be had to U.S. Pat. 4,868,600 granted to Hays et al on Sep. 19, 1989.

A sheet of support material 58 (FIG. 1) is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D.

Because the composite image developed on the photoreceptor consists of both positive and negative toner, a positive pre-transfer corona discharge member 56 is provided to condition the toner for effective transfer to a substrate using negative corona discharge.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, the toner powder image is permanently affixed to sheet 58. After fusing, a chute, not shown, guides the advancing sheet 68 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. A magnetic brush cleaner housing 70 is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush.

Subsequent to cleaning, a discharge lamp (not shown) floods the photoconductive surface with light to dissipate any residual electrostatic charge remaining prior to the charging thereof for the successive imaging cycle.

Figure 2:
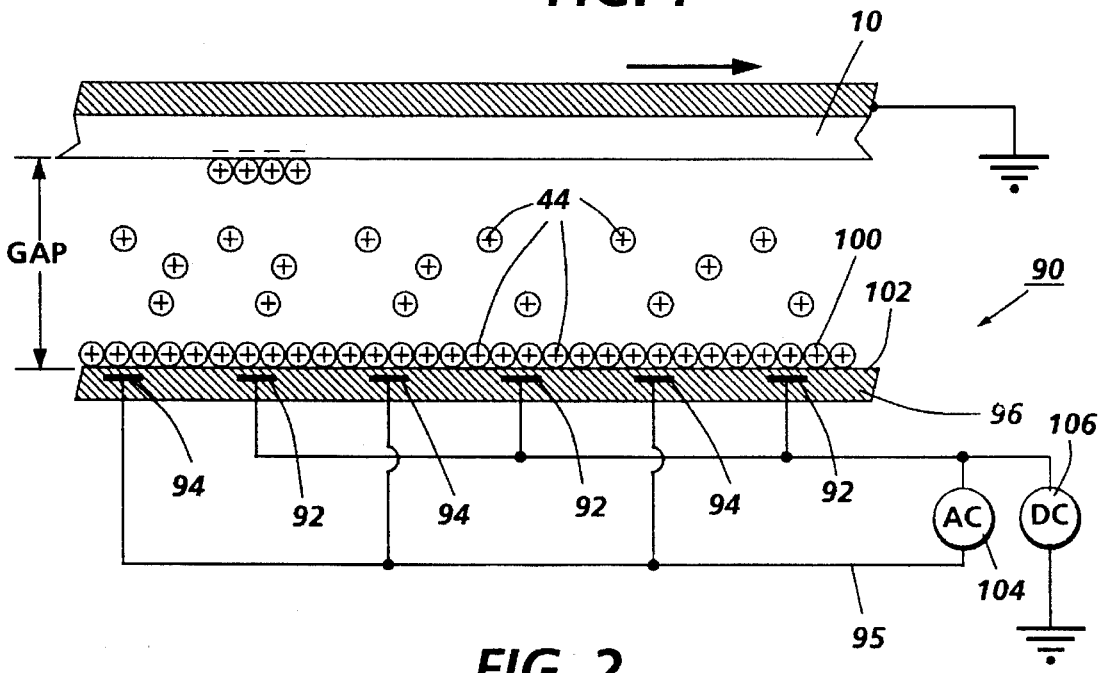
FIG. 2 is a fragmentary schematic view of a development structure according to the invention.

It is the purpose of the present invention to describe an improved donor structure in the form of a roller. A section of a toned donor structure in the development nip is shown in FIG. 2 as one embodiment 90 of the present invention. As illustrated therein, the structure 90 comprises first and second sets of electrodes 92 and 94. The toner donor structure 90 as incorporated in a donor roll is intended for use in a highlight color imaging device such as disclosed in FIG. 1 and it is intended to be used in place of the developer apparatus 34.

The two sets of electrodes 92 and 94 are arranged in an interdigitated fashion as shown on a dielectric base member 96. The electrodes are overcoated with a charge relaxable polymeric coating (not shown) fabricated from a polyurethane cationic dispersion having a thickness of approximately 5 μm and forming the outer surface of the donor structure 90. Thus, the electrodes are positioned in close proximity to a toner layer 100 on the donor surface 102. The gap between the donor structure 90 and the photoconductive surface 10 is approximately 250 μm. In this example, the electrodes are 60 μm wide with a center-to-center spacing of 100 μm.

An AC power source 104 applies an electrical bias of, for example, 400 volts peak at 4 kHz to the one set of electrodes 94. The electrical bias applied via lead 95. A DC bias from 0 to 1000 volts is applied by a DC power source 106 to all of the electrodes of both sets of electrodes 92 and 94. The AC applied to the one set of electrodes establishes AC fringe fields serving to liberate toner particles from the surface of the donor structure 90. The AC voltage is referenced to the DC bias applied to the electrodes so that the time average of the voltage applied to the AC biased electrodes bias is equal to the DC bias applied. Thus, the equal DC bias on adjacent electrodes precludes the creation of DC electrostatic fields between adjacent electrodes which would impede toner liberation by the AC fields. In order to preclude background development, the magnitude of the DC bias can be set to a value other than zero.

When the AC fringe field is applied to a toner layer via an electrode structure in close proximity to the toner layer, the time-dependent electrostatic force acting on the charged toner momentarily breaks the adhesive bond to cause toner detachment and the formation of a powder cloud or aerosol layer. The DC electric field from the electrostatic image controls the deposition of toner on the image receiver.

Figure 3:
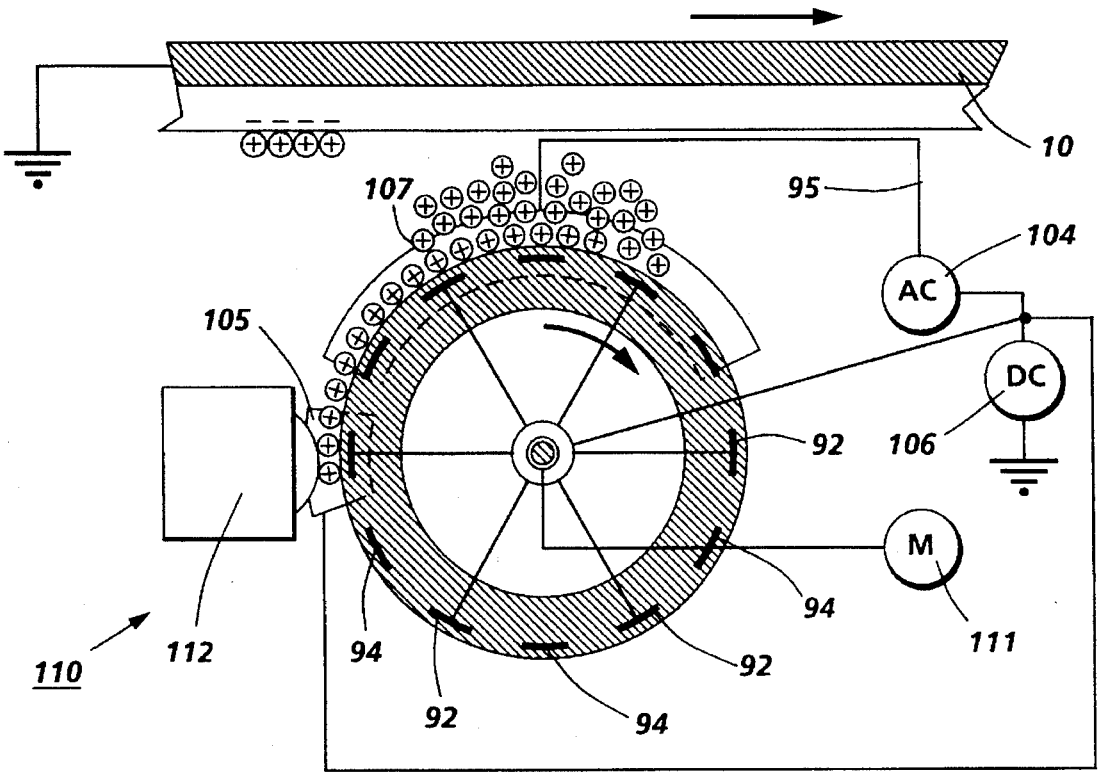
FIG. 3 is a fragmentary schematic view of another embodiment of a development structure according to the invention.

A donor roll structure 110 as depicted in FIG. 3 comprises a donor roll supported for rotation via a motor 111 and suitable drive transmission. The two sets of electrodes 92 and 94 are supported on a dielectric cylinder in a circular orientation by the donor roll. Each of the electrodes 94 are electrically isolated on the donor roll whereas all of the electrodes 92 are connected. AC and DC bias are applied to the electrode sets as in the case of the device shown in FIG. 2 except that the AC is commutated via a conductive brush 107 contacting only those electrically isolated electrodes 94, positioned in the nip between the photoconductive surface and the donor roll. If the toned donor is subjected to the AC fringe field in the absence of a receiver electrode, the development efficiency would be degraded. This observation implies that an AC field must be applied only in the development nip. Limiting the AC field region to a fraction of the nip width will help to reduce toner emissions (dirt) associated with other nonmagnetic development systems.

Toner is deposited on the donor roll 110 via a combination metering and charging device 112. To control the electrical bias on the electrically isolated electrodes 94 when positioned in the toner metering and charging device nip, a second conductive brush 105 is provided with a bias from the DC power supply 106, as illustrated in FIG. 3. The toner metering and charging can also be provided by a two component developer system such as a magnetic brush development structure. The donor structure can be rotated in either the 'with' or 'against' direction vis-a-vis the direction of motion of the charge retentive surface. The combination metering and charging device may comprise any suitable device for depositing a monolayer of well charged toner onto the donor structure 110. For example, it may comprise an apparatus such as described in U.S. Pat. No. 4,459,009 granted to Hays et al on Sep. 19, 1989 wherein the contact between weakly charged particles and a triboelectrically active coating contained on a charging roller results in well charged toner. Other combination metering and charging devices may be employed, for example, a conventional magnetic brush used with two component developer. U.S. Pat. No. 4,876,575 granted to Dan A. Hays on Oct. 24, 1989 discloses another combination metering and charging device suitable for use in the present invention.

Figure 4:
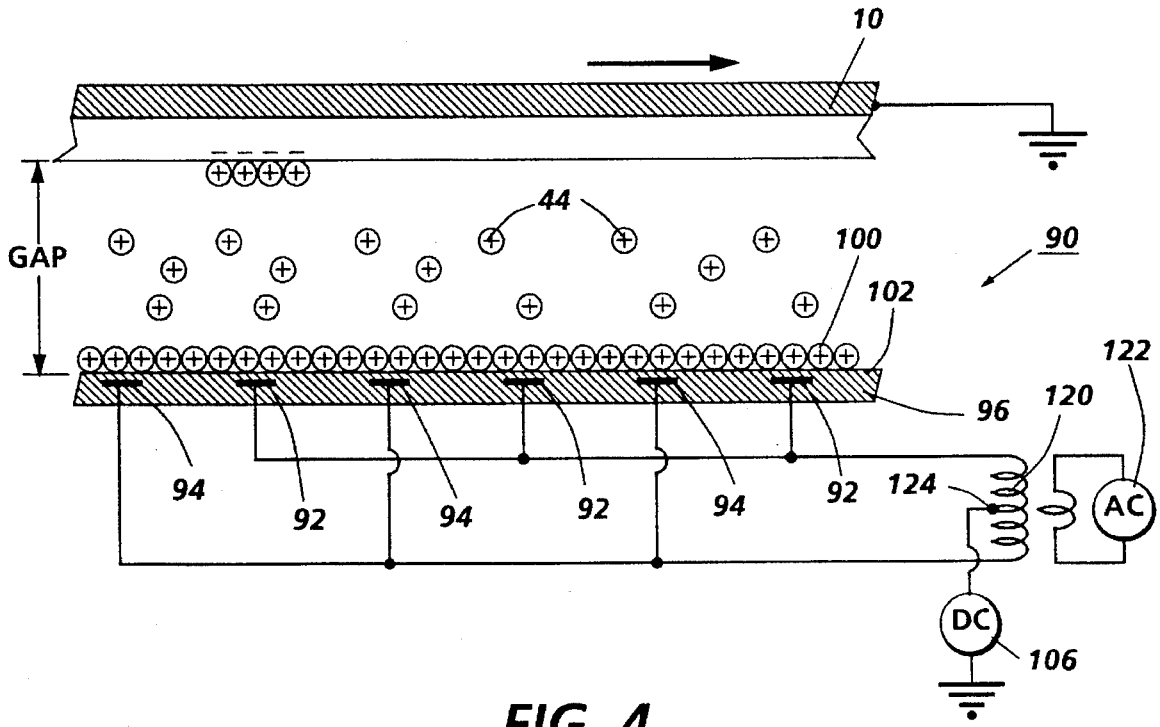
FIG. 4 is a schematic view of still another embodiment of a development structure according to the invention.

The donor roll structure 110 illustrated in FIG. 3, when AC is applied to one set of electrodes 94 by a commutator brush at one end of the roll, must be modified when AC is simultaneously applied to both sets of interdigitated electrodes as illustrated in FIG. 4. Each of the electrodes 92 must also be electrically isolated so that the AC is only applied in the development nip. The AC for this set of electrodes can be supplied by another commutator brush at the opposite end of the roll. Thus, the one set of electrodes 94 have +AC applied and the other set of electrodes 92 has −AC applied at any instant. However, the time average of both sets of electrodes is at the DC voltage provided by the DC bias connected to the center tap 124 of a secondary transformer winding 120 illustrated in FIG. 4.

What is claimed is:

1. Apparatus for forming images on a photoconductive surface with toner particles, said apparatus comprising:

means for forming latent electrostatic images on said photoconductive surface;

a donor member having toner particles thereon and supported adjacent said photoconductive surface for forming a nip area therebetween;

two sets of electrodes arranged on said donor member such that the electrodes of one of said two sets is interdigitated with the other of said two sets;

means for moving said donor member relative to said photoconductive surface for moving toner particles through said nip area;

means for applying an AC bias having a predetermined magnitude to at least one of said two sets of electrodes for creating alternating electrostatic fields between adjacent electrodes without creation of a traveling wave for liberating toner particles from said donor member; and means for applying a DC bias of equal magnitude to each of the electrodes of both sets of electrodes when passing through said nip area whereby toner particles liberated from said donor member develop said images without developing non-imaged areas of said photoconductive surface and without DC fields being created between adjacent electrodes.

2. Apparatus according to claim 1 wherein said donor member comprises an insulative portion supporting said two sets of electrodes.

3. Apparatus according to claim 2 wherein said AC bias is applied to both of said two sets of electrodes.

4. Apparatus according to claim 2 wherein said donor member comprises a donor roll.

5. Apparatus according to claim 3 wherein said AC bias applying means comprises the secondary winding of a transformer, one end of said secondary winding being operatively connected to one of two sets of electrodes for supplying a positive AC bias thereto and another end of secondary winding being operatively connected to the other of said two sets of electrodes for supplying a negative AC bias thereto.

6. Apparatus according to claim 5 wherein said DC bias is supplied to the center tap of said secondary winding.

7. A Method of forming images on a photoconductive surface with toner particles, said method including the steps of:

forming latent electrostatic images on said photoreceptor surface;

positioning a donor member having toner particles thereon adjacent said photoconductive surface;

providing two sets of electrodes on said donor member arranged such that the electrodes of one of said two sets is interdigitated with the other of said two sets;

moving said donor member relative to said photoconductive surface for moving toner particles to said nip area intermediate said donor member and said photoconductive surface;

applying an AC bias having a predetermined magnitude to at least one of said two sets of electrodes for creating alternating electrostatic fields between adjacent electrodes for liberating toner particles from said donor member without creating a traveling wave; and applying a DC bias of equal magnitude to each of the electrodes of both sets of electrodes when passing through said nip whereby toner particles liberated from said donor member develop said images without developing non-imaged areas of said photoconductive surface and without DC fields being created between adjacent electrodes.

8. The method according to claim 7 wherein said donor member comprises an insulative portion supporting said two sets of electrodes.

9. The method according to claim 8 wherein said AC bias is applied to both of said two sets of electrodes.

10. The method according to claim 8 wherein said donor member comprises a donor roll.

11. The method according to claim 10 wherein said AC bias applying means comprises the secondary winding of a transformer, one end of said secondary winding being operatively connected to one of two sets of electrodes for supplying a positive AC bias thereto and another end of secondary winding being operatively connected to the other of said two sets of electrodes for supplying a negative AC bias thereto.

12. The method according to claim 11 wherein said DC bias is supplied to the center tap of said secondary winding.

* * * * *